United States Patent [19]

Tabler et al.

[11] Patent Number: 4,789,460

[45] Date of Patent: Dec. 6, 1988

[54] PROCESS FOR FACILITATING FILTRATION OF USED LUBRICATING OIL

[75] Inventors: Donald C. Tabler, Fort Collins, Colo.; Marvin M. Johnson, Bartlesville, Okla.

[73] Assignee: Phillips Petroleum Company, Bartlesville, Okla.

[21] Appl. No.: 83,262

[22] Filed: Aug. 10, 1987

[51] Int. Cl.[4] ..... C10M 11/00

[52] U.S. Cl. ..... 208/180; 208/177; 208/290; 210/727; 210/729; 252/51

[58] Field of Search ..... 208/180, 181, 182, 177, 208/290; 210/727, 729; 252/51 R; 44/64

[56] References Cited

U.S. PATENT DOCUMENTS

| | | | |
|---|---|---|---|
| Re. 29,908 | 2/1979 | Fowler et al. | 210/727 |
| 1,882,002 | 10/1932 | Dietrich | 208/180 |
| 1,990,359 | 2/1935 | Ambler | 196/16 |
| 2,568,583 | 9/1951 | Graves | 196/16 |
| 2,674,565 | 4/1954 | Myers | 196/18 |
| 2,687,375 | 8/1954 | Fischer et al. | 252/8.5 |
| 2,951,031 | 8/1960 | Barclay | 208/180 |
| 3,003,350 | 10/1961 | Stewart | 73/64 |
| 3,282,827 | 11/1966 | Grysiak, Jr. | 208/180 |
| 3,948,904 | 4/1967 | Okamoto | 252/515 A |
| 3,985,642 | 10/1976 | Friel et al. | 208/180 |
| 4,029,569 | 6/1977 | Ivey, Jr. | 208/180 |
| 4,097,369 | 6/1978 | Ebel et al. | 208/180 |
| 4,102,827 | 7/1978 | Rembaum et al. | 210/736 |
| 4,287,049 | 9/1981 | Tabler et al. | 208/180 |
| 4,432,865 | 2/1984 | Norman | 208/181 |
| 4,522,729 | 6/1985 | Tabler | 217/727 |

FOREIGN PATENT DOCUMENTS

| | | | |
|---|---|---|---|
| 51-73005 | 6/1976 | Japan | 208/180 |

OTHER PUBLICATIONS

Pamphlet by Rohm & Haas Company entitled *Triton RW-Surfactants*, No. CS-450 (Jul., 1982).

*Primary Examiner*—H. M. Sneed
*Assistant Examiner*—Helane Myers
*Attorney, Agent, or Firm*—Laney, Dougherty, Hessin & Beavers

[57] ABSTRACT

A process for filtering contaminants from oil is provided. A polyalkoxyalkylamine is admixed with the oil in an amount sufficient to improve the filtration rate thereof. The polyalkoxyalkylamine is particularly suitable for use in processes for removing impurities from used lubricating oil wherein the oil is admixed with a treating agent to form a precipitate of the impurities and the impurities are filtered from the oil.

30 Claims, 1 Drawing Sheet

PROCESS FOR FACILITATING FILTRATION OF USED LUBRICATING OIL

BACKGROUND OF THE INVENTION

1. Field of the Invention

The present invention relates generally to processes for filtering solid impurities from oil, and more particularly, but not by way of limitation, to processes for purifying used lubricating oil to obtain an intermediate low-ash oil or a high-grade lube oil stock.

2. Description of the Prior Art

Due to the amount of compounds being added to lubricating oil to increase the performance thereof and due to the nature of most used lubricating oil available for re-refining, processes for re-refining or reclaiming used lubricating oil have become more complex.

Many compounds such as detergents, pour point depressants, oxidation inhibitors and viscosity index improvers are now added to lubricating oil to increase the performance thereof. For example, detergents are often added to suspend resins, carbon, dirt, wear metal particles and other impurities in the oil so that the impurities will remain with the oil when the oil is changed. Unfortunately, the additive compounds can be very difficult to remove from the oil after it is used.

Due to the fact that most service stations place all crank case drainings into a common tank, most used lubricating oil available for reclaiming processes is a blend of used lubricating oil from both gasoline and diesel engines. Waste oil containing a significant concentration of oil drained from diesel engines is more difficult to reclaim than that without, most likely because of the high level of carbon and/or soot particles present in used oil from diesel engines. The presence of various dispersants found in lubricating oil often hinders the agglomeration of such particles.

Various processes have been developed to remove additives and foreign particles from used lubricating oil. In many of these processes, the used oil is admixed with a treating agent which reacts with ash-forming contaminants in the oil to form a precipitate of reacted contaminants. The treated oil is then subject to filtration to remove the precipitate of reacted contaminants from the oil. Certain compounds can be added to the reaction mixture to facilitate the filtration step.

By the present invention, an improved process for facilitating filtration of used lubricating oil is provided.

SUMMARY OF THE INVENTION

An improved process for filtering contaminants from oil is provided. A polyalkoxyalkylamine is admixed with the oil in an amount sufficient to improve the filtration rate thereof. The polyalkoxyalkylamine is very effective in processes for removing impurities from used lubricating oil wherein the oil is admixed with a treating agent to form a precipitate of the impurities and the impurities are filtered from the oil. It is particularly effective in facilitating filtration of used lubricating oil when the oil contains a significant concentration of oil from diesel engines. It serves to coagulate soot particles and other ash-forming contaminants in the oil, thereby producing a precipitate which is more easily removed.

In a preferred embodiment of the invention, a polyalkoxyalkylamine is added to the used lubricating oil to be treated, the used lubricating oil and polyalkoxyalkylamine are contacted with an aqueous solution of an ammonium salt treating agent under conditions of temperature and pressure sufficient to cause ash-forming contaminants present in the oil to precipitate, and the treated oil is filtered.

Preferably, the polyalkoxyalkylamine admixed with the oil is a polyethoxyalkylamine. The polyethoxyalkylamine is predominantly present in salt or ionic form when it is admixed with the oil if the pH of the solution is less than 7. It is predominantly present in the form of a nonionic amine when it is admixed with the oil if the pH of the solution is greater than 10.

From the foregoing description of the present invention, it will be apparent that an important object of the invention is to provide an improved process for filtering contaminants from used lubricating oil, particularly used lubricating oil containing a significant amount of oil used in diesel engines.

Numerous other objects, features and advantages of the present invention will be readily apparent to those skilled in the art upon a reading of the following disclosure including the examples provided therewith.

DETAILED DESCRIPTION OF THE PREFERRED EMBODIMENTS

Figure 1:
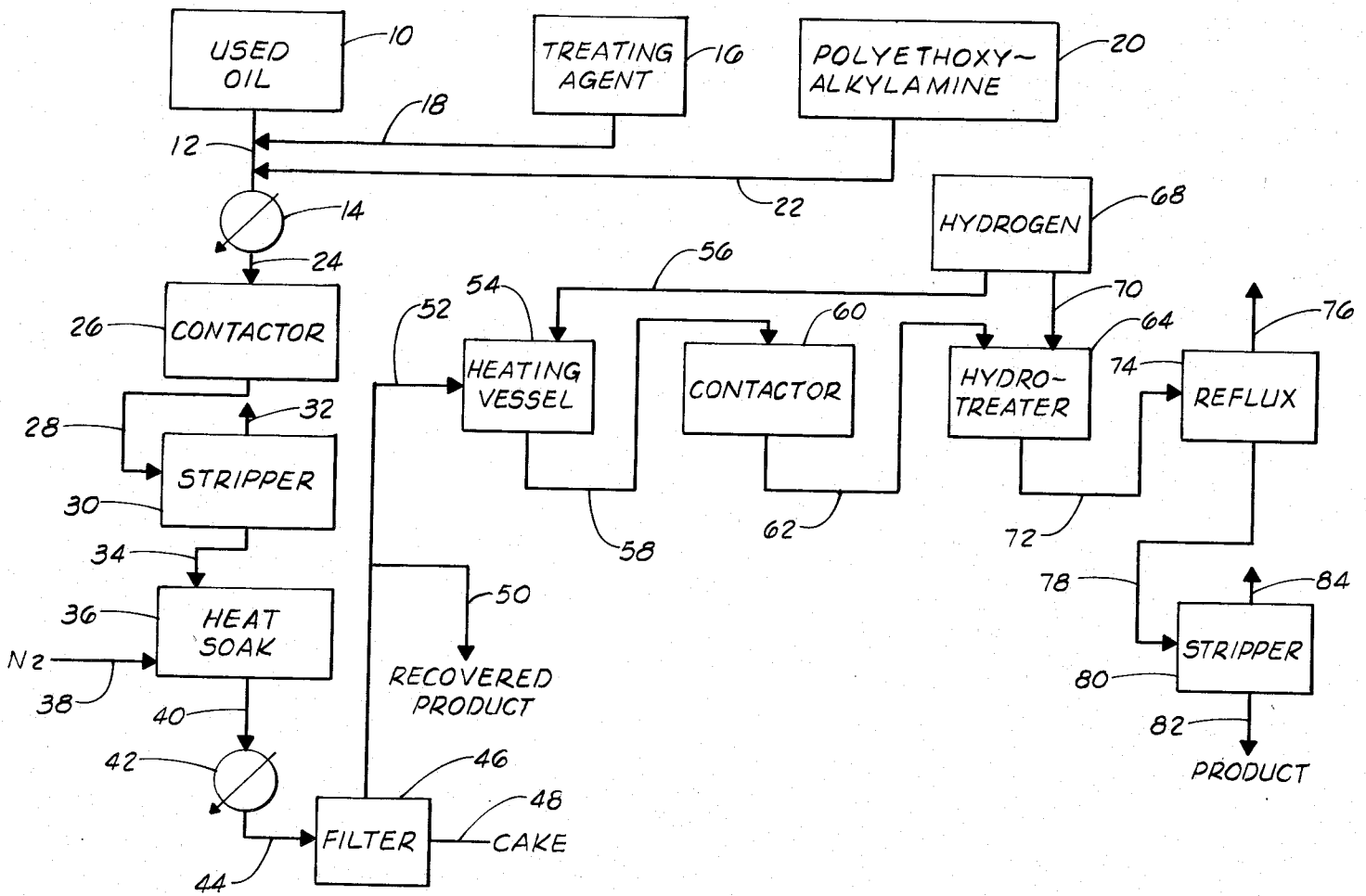
FIG. 1 is a schemaic diagram showing a particular process in which the present invention can be employed.

In accordance with the present invention, a process for filtering contaminants from oil is provided. A polyalkoxyalkylamine is admixed with the oil in an amount sufficient to improve the filtration rate thereof. In a process for removing impurities from used lubricating oil wherein the oil is admixed with a treating agent to form a precipitate of the impurities and the impurities are filtered from the oil, the polyalkoxyalkylamine is added to the oil prior to, with, or subsequent to the addition of the treating agent. Preferably, the polyalkoxyalkylamine is added to the oil prior to or at the same time as the addition of the treating agent.

The polyalkoxyalkylamine used in accordance with the present invention is preferably a polyethoxyalkylamine. The polyethoxyalkylamine is preferably made by the reaction of a t-alkyl primary amine with ethylene oxide. By combining a cationic amine group with a nonionic polyethoxy chain, a compound is provided whose surface-active properties and water solubility depend directly on the pH of the reaction medium where it is employed.

At a pH of 10 or higher, the polyethoxyalkylamine is predominantly present in the form of a nonionic amine represented by the general formula (1) below:

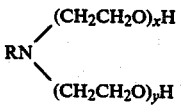

(1)

wherein:

R is an alkyl group;

x is from 1 to about 15; and y is from 1 to about 15.

At a pH of about 7 and lower, the polyethoxyalkylamine is predominantly present in ionic or salt form and is represented by the general formula (2) below:

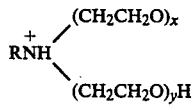

(2)

wherein:

R is an alkyl group;

x is from 1 to about 15; and y is from 1 to about 15.

In many applications, the pH of the oil and other substances admixed therewith is continually below 7. In such applications, the polyethoxyalkylamine predominantly functions as a salt. Inasmuch as the polyethoxyalkylamine is more effective as a salt, it is desirable for it to be present in this form.

A series of polyethoxyalkylamines suitable for use in accordance with the present invention is commercially available from Rohm & Haas Company. The series is marketed under the trademark TRITON RW-SURFACTANTS. The members of the series differ according to the length of the polyoxyethylene chains. Their solubilities range from soluble in oil for the members with the shorter chains to highly soluble in water for the members with the longer chains.

The members of the series and the corresponding lengths of the polyoxyethylene chains as represented by the sum of x and y in the general formulas (1) and (2) described above are as follows:

| Member | (x + y) |
|---|---|
| TRITON RW- 20 | 2 |
| TRITON RW- 50 | 5 |
| TRITON RW- 75 | 7.5 |
| TRITON RW- 100 | 10 |
| TRITON RW- 150 | 15 |

This series of compounds is described in a pamphlet put out by Rohm & Haas Company entitled TRITON® RW-SURFACTANTS, No. CS-450 (July, 1982), which is incorporated herein by reference.

When polyethoxyalkylamines are used in accordance with the process of the present invention, their solubility in water increases as the length of the polyoxyethylene chains increases. The compounds are very effective in coagulating soot particles and other ash-forming contaminants present in used lubricating oil. A precipitate is produced which is more easily filtered. As a result, filtration rates are increased two to three fold.

Polyethoxyalkylamines having long polyoxyethylene chains are more effective than those with short chains. Preferably, the total sum of x and y in the general formulas (1) and (2) described above is either 7.5 (RW-75), 10 (RW-100) or 15 (RW-150). R preferably has from about 4 to about 12 carbon atoms.

The polyethoxyalkylamine used in accordance with the present invention should be admixed with the used oil in an amount sufficient to improve filtration of the solid materials from the treated oil. The polyethoxyalkylamine is preferably admixed with the oil in an amount such that it imparts to the resultant composition in the range of from about 0.02 percent to about 2.0 percent by weight polyethoxyalkylamine based on the total weight of the resultant composition, more preferably in the range of from about 0.1 percent to about 2.0 percent by weight polyethoxyalkylamine based on the total weight of the resultant composition. Most preferably, the polyethoxyalkylamine is admixed with the oil in an amount such that it imparts to the resultant composition about 0.5 percent by weight polyethoxyalkylamine based on the total weight of the resultant composition.

The present invention can be used to filter contaminants from oil in any type of process. It is preferably used in processes for treating used lubricating oil to obtain an intermediate low-ash oil or a high-grade lube oil stock. Processes of this type are described in U.S. Pat. No. 4,287,049 and U.S. Pat. No. 4,522,729, the disclosures of which are incorporated herein by reference.

The preferred process of the present invention basically comprises the steps of contacting a mixture of used lubricating oil with a treating agent under conditions of temperature and pressure sufficient to allow reaction of the treating agent with ash-forming contaminants present in the oil to produce a precipitate of reacted contaminants, admixing a polyethoxyalkylamine with the mixture of oil to coagulate soot particles and other ash-forming contaminants present in the oil, and filtering the mixture of oil to remove the precipitate and contaminants therefrom. Although the polyethoxyalkylamine can be added at any time, it is preferably added prior to or concurrently with the treating agent. It is advantageous to have the polyethoxyalkylamine present before the precipitate begins to form.

The type of used lubricating oils particularly suitable for treatment by the process of the present invention consist primarily of oils that have been used for internal combustion lubrication purposes, e.g. oils used in gasoline and/or diesel engines. They are generally refined lubricating cuts from paraffin-base, mixed-base or naphthenic crudes. The oils almost always contain additives such as oxidation inhibitors, antiwear agents, rust inhibitors, dispersants, viscosity index improvers, detergents and ashless-type detergents.

The treating agent used to form a precipitate of reactive contaminants is preferably an ammonium salt treating agent selected from the group consisting of ammonium sulfate, ammonium bisulfate, ammonium phosphate, diammonium hydrogen phosphate, ammonium dyhydrogen phosphate, ammonium thiosulfate, ammonium polyphosphates, urea sulfate, guanidine sulfate, urea phosphate, guanidine phosphate and mixtures thereof. If desired, the treating agent can be formed in situ.

An aqueous solution of the treating agent is contacted with the used oil. A relatively concentrated solution should be used so that the amount of water required to be removed will not be too great. Preferably, the treating agent is present in the aqueous solution in a concentration in the range of from about 30 percent to about 95 percent by weight of the aqueous solution. Most preferably, the treating agent is present in the aqueous solution in a concentration of about 80 percent by weight of the aqueous solution.

It is not uncommon for used lubricating oil to contain some water. If so, the concentration of the treating agent in the aqueous solution of treating agent used can be adjusted accordingly. If desired, any water entrained from the used oil can be removed before the treating agent is added.

The amount of treating agent employed should be sufficient to react with all the metal constituents present in the used oil. The exact amount of treating agent that should be used varies depending upon many factors, including the nature and concentration of metal-containing compounds in the used oil, and the particular treating agent employed. Generally, the treating agent should be employed in an amount such that the weight ratio of the treating agent to the used oil is in the range of from about 0.002:1 to about 0.05:1, more specifically in the range of from about 0.005:1 to about 0.015:1. Typically, the treating agent should be employed in an amount such that the weight ratio of treating agent to used oil is about 0.01:1.

Referring now to FIG. 1 of the drawings, used lubricating oil is conducted from a storage tank 10 through a line 12 to a heater 14. An appropriate amount of treating agent is conducted from a storage tank 16 through a line 18 to the line 12, and is admixed with used oil therein. A polyethoxyalkylamine is conducted from a storage tank 20 through a line 22 to the line 12, and is admixed with the used oil and any treating agent therein. The polyethoxyalkylamine can be added to the used oil prior to, at the same time as or subsequent to the addition of the treating agent to the oil. It is preferably added prior to or at the same time as the addition of the treating agent.

After the admixture of used oil, treating agent, and polyethoxyalkylamine is heated in the heater 14, it is conducted through a line 24 to a contactor 26. In the contactor 26, sufficient agitation is provided to assure thorough dispersion of the aqueous treating agent and the polyethoxyalkylamine to the oil phase. The admixture is maintained in the contactor 26 for a period of time and under conditions sufficient to affect reaction of the treating agent with essentially all of the ash-forming contaminants present in the oil. As a result, a precipitate of reactive contaminants is produced.

Preferably, the reaction is conducted under a pressure in the range of from about atmospheric pressure to about 250 psia. Most preferably, the reaction is conducted under a pressure of about 20 psia. The reaction is preferably conducted at a temperature in the range of from about 60° C. to about 200° C. Most preferably, the reaction is conducted at a temperature of about 100° C. The treating agent is preferably maintained in contact with the used oil for a time in the range of from about ten minutes to about two hours, most preferably for about thirty minutes. If desired, small amounts of the treating agent and polyethoxyalkylamine can be added to the used oil either downstream of the heater 14 in the line 24 or directly in the contactor 26.

Water can be removed from the reaction mixture at this point. Although the water can be removed by any means, it is preferably removed by distillation. The reaction mass, which has a continuous oil phase, is conducted through a line 28 into a stripper 30. Upon passing downwardly through the stripper 30, the oil is preferably maintained at an elevated temperature and steam is preferably introduced to help remove light components and residual water from the system.

Prior to being filtered, the mixture of used oil, treating agent and polyethoxyalkylamine is preferably subjected to a heat soak step. The mixture is passed from the stripper 30 through a line 34 to a heat soak vessel 36. The purpose of subjecting the mixture to a heat soak treatment is to decrease the amount of ash contained in the filtered oil.

The heat soak treatment can be accomplished by heating at least a portion of the mixture to a temperature in the range of from about 320° C. to about 420° C., and maintaining the mixture at a temperature in that same range for an average residence time in the range of from about 5 minutes to about 2 hours. Preferably, the temperature is maintained in the range of from about 340° C. to about 370° C. for a time in the range of from about 15 minutes to about 60 minutes. A flowing nitrogen purge can be provided to minimize oxidation of the oil by passing nitrogen into the heat soak vessel 36 through a conduit 38.

The mixture is then passed from the heat soak vessel 36 through a line 40 to a heat exchanger 42 in order to cool it to a temperature suitable for filtration, a temperature preferably in the range of from about 100° C. to about 180° C. The mixture is difficult to filter if the temperature is too high.

Next, the cooled mixture is filtered. The filtration step removes suspended and entrained ash-forming contaminants present in the mixture. The mixture is passed from the heat exchanger 42 through a conduit 44 to a filter 46. Preferably, the filter 46 is precoated with a suitable filter aid. Suitable filter aids include diatomaceous earth, perlite, cellulose fibers and mixtures thereof. It may also be desirable to incorporate filter aid into the oil at a point downstream of the stripper 30 and upstream of the filter 46. Filter cake can be removed through a conduit 48 for further treatment.

The filtered oil can be removed from the filter 46 through a line 50 without further treatment. Used oil at this point in an overall treating system can be used as a fuel oil, in grease formulations, or in the preparation of some types of lubricating oil formulations. It is preferred, however, to further treat the filtered oil product to remove various organic compounds and the like that were not removed by the filtration step.

For further treatment, oil is passed through a line 52 into a heater 54. It is heated to a temperature in the range of from about 200° C. to about 480° C. A first portion of hydrogen can be added to the heating vessel 54 through a line 56 if desired.

The heated oil is then passed through a line 58 into a contactor 60 wherein decomposition of sulfonates contained in the oil is effected. An adsorbent such as bauxite, activated carbon, silica gel, clay, activated alumina and the like is provided in the contactor 60. The adsorbent serves to effect breakdown and decomposition of ammonium salts of sulfonic acids and ashless detergents contained in the oil. The adsorbent also serves to collect a small portion of the resulting products and thus precludes passage of undesirable decomposition products through the system.

Instead of passing the mixture from the heating vessel 54 to the contactor 60, small amounts of ash components and highly polar materials present in the low-ash filtered oil can be removed by heating the oil to a temperature in the range of from about 300° C. to about 410° C., preferably about 380° C., in the presence of hydrogen and an adsorbent suspended in the oil. After such treatment, the oil is cooled to a temperature in the range of from about 60° C. to about 200° C., preferably about 150° C., and is then refiltered. The same absorbents suitable for use in the contactor 60, if it is used, can be used in accordance with this alternative treatment.

The resulting treated oil is passed through a line 62 to a hydrotreater 64, which is maintained at an elevated temperature. The hydrotreater 64 serves to effect destruction of various additive systems previously added to the original oil stocks. The hydrogen required for the hydrotreating reaction can be conducted from a source 68 through a line 70 into the hydrotreater 64. As stated above, hydrogen can also be added to the system by adding it to the heating vessel 54 through the line 56.

In the hydrotreater 64, the oil is subjected to hydrogenation conditions in the presence of catalyst sufficient to remove unwanted compounds and unsaturated materials and to effect decomposition of residual sulfur, oxygen and nitrogen bodies so as to yield an oil product suitable for further purification to a lube stock. The catalyst employed is preferably selected from the group consisting of Group VIB and Group VIII metals and combinations thereof, on a refractory support, used in conventional hydrodesulfurization processes.

Next, the resulting oil is passed through a line 72 to a separator-reflux column 74. The separator-reflux column 74 serves to remove water and various other by-products of the previous treatments. Water can be injected into the line 74 to help remove any HCl and part of the $H_2S$ and $NH_3$ as water-soluble salts such as ammonium chloride and ammonium sulfides. A stream comprising hydrogen, $H_2S$, $NH_3$, vaporized lube oil and fuel fraction can be removed from the column 74 as an overhead stream 76 and subjected to further treatment.

The bottoms product from the column 74 is passed through a line 78 to a stripper 80, wherein a further steam treatment is carried out. Stripping, preferably steam stripping, is very important to the integrated process of the present invention since it serves to remove those light hydrocarbon products boiling below the oil, such as kerosene or heavy gasoline, which have remained entrained in the oil or which are by-products of the hydrogenation treatment. As an alternative, gas stripping with hydrogen or the like can be employed.

The resulting hot stripped product, essentially consisting of a pure lube oil stock, is cooled and passed through a conduit 82 to a storage tank or the like. The oil stock can then be used as an additive-free lube oil stock suitable for reformulation with additives as desired.

Fuel oil, water and the like can be removed as an overhead stream from the stripper 80 through a conduit 84.

In order to illustrate and facilitate a clear understanding of the process of the present invention, the following example is given.

EXAMPLE

The five members of the TRITON RW-series of polyethoxyalkylamines were tested for their ability to improve the filtration rate in a process for purifying used lubricating oil. A test procedure for actually simulating a re-refining process was established. The mixture of used lubricating oil used for the tests was obtained from Indesa, a subsidiary of Texaco Mexicana operating in Queretaro, Mexico. It contained waste oil from several sources including drainings from both gasoline and diesel engines.

In the first test, a portion of the mixture of used oil was treated without adding a polyethoxyalkylamine to the reaction solution. One hundred grams of the waste oil were placed in a 250 milliliter beaker and heated to 190° F. Three milliliters of a diammonium hydrogen phosphate (DAP) solution containing 0.273 grams DAP per milliliter of solution, and 7 milliliters of distilled water were added to the oil. Upon continuous stirring, the mixture was slowly heated until it reached a temperature of 250° F., and rapidly heated thereafter until it reached a temperature of 350° F.

The mixture was then subjected to a heat soak treatment under a flowing $N_2$ purge to avoid oxidation of the oil. The mixture was transferred to a 250 milliliter flask, subjected to the flowing nitrogen purge, and heated to a temperature of 650° F. After maintaining it at 650° F. for one hour, the mixture was cooled to a temperature of 450° F. A one gram portion of Eagle Pitcher FP-4 filter-aid was added, and the mixture was further cooled to 350° F. The cooled mixture was then filtered through a 5.8 centimeter Buchner funnel that was pre-coated with 5 grams of the Eagle pitcher FP-4 filter-aid. In order to determine the filtration rate, the filter time and the amount of filtrate recovered were measured and recorded.

For the next test, a stock solution of TRITON RW-20 polyethoxyalkylamine ($x+y=2$) was made by placing 10.0 grams of TRITON RW-20 (100% active) in a 100 milliliter volumetric flask and adding a sufficient amount of isopropanol to make the total volume of solution in the flask 100 milliliters.

The same test procedure used in the first test was used to test the effectiveness of the TRITON RW-20, except that five milliliters of the TRITON RW-20 solution were added to the mixture of used oil together with the DAP solution and distilled water. The filter time and amount of filtrate recovered were measured and recorded, and the filtration rate was determined.

TRITON RW-150 polyethoxyalkylamine ($x+y=15$) was tested in the third test. As in the second test, a stock solution of the TRITON RW-150 containing 0.1 grams per milliliter active ingredient was made up. In this and the remaining tests, water was used as the solvent. Isopropanol was used as the solvent for TRITON RW-20 because TRITON RW-20 is not very soluble in water.

The exact procedure used in the second test was followed in the third test except that 2 milliliters of distilled water instead of 7 milliliters of distilled water were added to the oil.

The TRITON RW-100 ($x+y=10$), TRITON RW-75 ($x+y=7.5$) and TRITON RW-50 ($x+y=5$) polyethoxyalkylamines were tested in the fourth, fifth and sixth tests respectively. As in the second and third tests, a stock solution containing 0.1 grams per milliliter active ingredient of the polyoxyalkylamine to be tested was made up for each test. The procedure followed was the same as the procedure followed in the third test (RW-150).

The results of the tests are summarized in Table I below.

TABLE I

| Member of TRITON RW-Series Added | Concentration of Member Added[1] (Wt. %) | Filter Time (Seconds) | Amount of Filtrate Recovered (Milliliters) | Filtration Rate (gal/hr.-ft.$^2$) |
|---|---|---|---|---|
| NONE | — | 219 | 56.0 | 8.6 |
| RW-20 | 0.5 | 86 | 48.0 | 18.7 |
| RW-50 | 0.5 | 81 | 51.5 | 21.3 |
| RW-75 | 0.5 | 60 | 49.0 | 27.4 |
| RW-100 | 0.5 | 69 | 54.0 | 26.2 |
| RW-150 | 0.5 | 68 | 55.0 | 27.1 |

[1]based on total weight of oil

The results of the tests clearly show that the filtration rate in processes for filtering contaminants from used lubricating oil can be substantially increased by admixing a polyethoxyalkylamine with the oil. The results show that polyethoxyalkylamines are very effective in coagulating soot particles and other ash-forming contaminants present in the oil. The tests also show that the members of the TRITON RW-series of polyethoxyalkylamines having the longer chains, namely RW-75, RW-100 and RW-150, are the most effective.

The preceeding example can be repeated with similar success by substituting the generically or specifically described reactants and/or operating conditions of this invention for those used in the example.

From the foregoing description, one skilled in the art can easily ascertain the essential characteristics of this invention, and without departing from the spirit and scope thereof, can make various changes and modifications of the invention to adapt it to various usages and conditions. For example, one skilled in the art can use the polyethoxyalkylamines of the present invention to improve the filtration rate in any process for filtering contaminants from oil. The description of the particular process is provided merely to illustrate and facilitate a clear understanding of the process of this invention.

What is claimed is:

1. In a process for filtering contaminants from oil, the improvement comprising admixing a polyalkoxyalkylamine with said oil in an amount sufficient to coagulate at least a portion of said contaminants and to improve the filtration rate of said oil.

2. The process of claim 1 wherein said polyalkoxyalkylamine is a polyethoxyalkylamine.

3. The process of claim 2 wherein if said oil has a pH of less than 7, said polyethoxyalkylamine, when admixed therewith, is predominantly present in the form of a compound represented by the general formula:

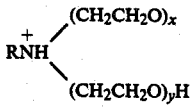

wherein:

R is an alkyl group;

x is from 1 to about 15; and y is from 1 to about 15.

4. The process of claim 3 wherein the total sum of x and y is about 2.

5. The process of claim 3 wherein the total sum of x and y is about 5.

6. The process of claim 3 wherein the total sum of x and y is about 7.

7. The process of claim 3 wherein the total sum of x and y is about 10.

8. The process of claim 3 wherein the total sum of x and y is about 15.

9. The process of claim 3 wherein R has from about 4 to about 12 carbon atoms.

10. The process of claim 2 wherein said polyethoxyalkylamine is admixed with said oil in an amount such that it imparts to said oil in the range of from about 0.02 percent to about 2 percent by weight polyethoxyalkylamine based on the weight of said oil and said polyethoxyalkylamine.

11. The process of claim 10 wherein said polyethoxyalkylamine is admixed with said oil in an amount such that it imparts to said oil about 0.5 percent by weight polyethoxyalkylamine based on the weight of said oil and said polyethoxyalkylamine.

12. In a process for removing impurities from used lubricating oil wherein the oil is admixed with a treating agent to form a precipitate of the impurities and the impurities are filtered from the oil, the improvement comprising adding a polyethoxyalkylamine to said oil in an amount sufficient to coagulate at least a portion of said impurities and to improve the rate of filtration of said impurities from said oil, said polyethoxyalkylamine being predominantly present in the form of a compound represented by the general formula:

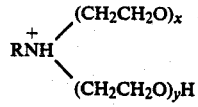

wherein:

R is an alkyl group;

x is from 1 to about 15; and y is from 1 to about 15, when added to said oil if said oil has a pH less than 7, and being predominantly present in the form of a nonionic amine represented by the general formula:

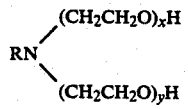

wherein:

R is an alkyl group;

x is from 1 to about 15; and y is from 1 to about 15, when added to said oil if said oil has a pH greater than 10.

13. The process of claim 12 wherein the total sum of x and y is from about 2 to about 15.

14. The process of claim 13 wherein the total sum of x and y is about 7.5.

15. The process of claim 13 wherein the total sum of x and y is about 10.

16. The process of claim 13 wherein the total sum of x and y is about 15.

17. The process of claim 12 wherein R has from about 4 to about 12 carbon atoms.

18. The process of claim 12 wherein said polyethoxyalkylamine is added to said oil in an amount such that it imparts to said oil in the range of from about 0.1 percent to about 2 percent by weight polyethoxyalkylamine based on the weight of said oil and said polyethoxyalkylamine.

19. The process of claim 12 wherein said polyethoxyalkylamine is added to said oil in an amount such that it imparts to said oil about 0.5 percent by weight polyethoxyalkylamine based on the weight of said oil and said polyethoxyalkylamine.

20. A process for removing impurities from a collection of used lubricating oil including used diesel oil, comprising:

adding a polyalkoxyalkylamine to said collection of used lubricating oil to coagulate soot particles and other ash-forming contaminants present therein;

contacting said collection of used lubricating oil with a treating agent under conditions of temperature and pressure sufficient to cause said soot particles and other ash-forming contaminants present in said collection of used lubricating oil to precipitate; and filtering said collection of used lubricating oil to remove said soot particles and other ash-forming contaminants therefrom.

21. The process of claim 20 wherein said polyalkoxyalkylamine is a polyethoxyalkylamine.

22. The process of claim 21 wherein if the pH of said collection of used lubricating oil is less than 7, said polyethoxyalkylamine, when added thereto, is predominately present in the form of a compound represented by the general formula:

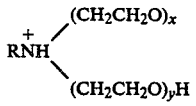

wherein:

R is an alkyl group;

x is from 1 to about 15; and y is from 1 to about 15.

23. The process of claim 22 wherein the total sum of x and y is from about 2 to about 15.

24. The process of claim 22 wherein the total sum of x and y is about 7.5.

25. The process of claim 22 wherein the total sum of x and y is about 10.

26. The process of claim 22 wherein the total sum of x and y is about 15.

27. The process of claim 22 wherein R has from about 4 to about 12 carbon atoms.

28. The process of claim 21 wherein said polyethoxyalkylamine is added to said oil in an amount such that it imparts to said oil in the range of from about 0.02 percent to about 2.0 percent by weight polyethoxyalkylamine based on the weight of said oil and said polyethoxyalkylamine.

29. The process of claim 28 wherein said polyethoxyalkylamine is added to said oil in an amount such that it imparts to said oil about 0.5 percent by weight polyethoxyalkylamine based on the weight of said oil and said polyethoxyalkylamine.

30. The process of claim 21 wherein if the pH of said collection of used lubricating oil is greater than 10, said polyethoxyalkylamine, when added thereto, is predominantly present in the form of a nonionic amine represented by the general formula:

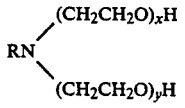

wherein:

R is an alkyl group;

x is from 1 to about 15; and y is from 1 to about 15.

* * * * *